United States Patent [19]

Higgins

[11] Patent Number: 4,784,231

[45] Date of Patent: Nov. 15, 1988

[54] EXTENDED DRILL BIT NOZZLE HAVING SIDE DISCHARGE PORTS

[75] Inventor: Dean T. Higgins, Mustang, Okla.

[73] Assignee: Dresser Industries, Inc., Dallas, Tex.

[21] Appl. No.: 83,693

[22] Filed: Aug. 7, 1987

[51] Int. Cl.[4] ..... E21B 9/08

[52] U.S. Cl. ..... 175/340; 175/393

[58] Field of Search ..... 175/339, 340, 393, 424

[56] References Cited

U.S. PATENT DOCUMENTS

| | | | |
|---|---|---|---|
| 2,104,823 | 1/1938 | Sherman | 255/71 |
| 2,192,693 | 3/1940 | Payne | 255/71 |
| 2,260,487 | 10/1941 | Scott | 255/71 |
| 2,885,186 | 5/1959 | Hammer | 255/314 |
| 3,070,182 | 12/1962 | Runte | 175/339 |
| 3,111,179 | 11/1963 | Albers et al. | 175/393 |
| 3,744,581 | 7/1973 | Moore | 175/340 |
| 4,071,097 | 1/1978 | Fulop et al. | 175/56 |
| 4,077,482 | 3/1978 | Ioannesian et al. | 175/340 |
| 4,082,015 | 4/1978 | Craig | 76/108 A |
| 4,106,577 | 8/1978 | Summers | 175/340 |
| 4,187,921 | 2/1980 | Garner | 175/340 |
| 4,687,066 | 8/1987 | Evans | 175/340 |
| 4,687,067 | 8/1987 | Smith et al. | 175/340 |

FOREIGN PATENT DOCUMENTS

| | | | |
|---|---|---|---|
| 1146530 | 5/1983 | Canada | 175/339 |
| 370333 | 11/1973 | U.S.S.R. | 175/340 |

*Primary Examiner*—Jerome W. Massie
*Assistant Examiner*—William P. Neuder

[57] ABSTRACT

A replaceable fluid nozzle is provided for well hole drill bits. The nozzle includes a main discharge port directed downward between adjacent cutting cones of the drill bit, and two side discharge ports directed toward the leading and trailing cutter cone backfaces, respectively. The side discharge ports direct jets of drilling fluid to wash away formation fines and shale packings from around the cutter cone bearing seals. The side jets of fluid remove abrasive particles to prolong the life of the cutter cone bearings and seals.

5 Claims, 1 Drawing Sheet

EXTENDED DRILL BIT NOZZLE HAVING SIDE DISCHARGE PORTS

TECHNICAL FIELD

The present invention relates to drilling fluid nozzles for well hole drill bits and, in particular, to an extended nozzle having a downwardly directed main discharge port and side ports for directing fluid to wash formation cuttings away from the cutter cone bearing seals.

BACKGROUND OF THE INVENTION

The use of high pressure drilling fluid in conjunction with earth boring drill bits is well known in the field of well hole drilling. Drilling fluid nozzles generally are provided at the drill bit for directing fluid to clean and cool the cutting elements and to flush the formation cuttings toward the surface. Various drilling fluid flow paths are utilized depending, to some extent, on the composition of the earth formation being drilled. Most drill bits include downwardly directed nozzles for flushing and removing the formation cuttings from the bottom of the well hole. Some drill bits include nozzles that direct drilling fluid on the cutting elements to prevent clogging and balling up of the cutting elements in earth formations such as shale.

Many drill bits in current operation utilize rolling cutter cones mounted on the bit with sealed journal or roller bearings. During drilling operations, it is possible for drilling fines and shale packings to enter the bearing seal glands, thereby causing abrasion which lessens the life of the seals. If the seals are destroyed, the abrasive material can cause failure of the bearings. In any event, the life of the cutter cones can be significantly reduced due to failure of the bearings or the bearing seals. Although drilling fluid nozzles have been designed for cleaning and cooling the cutting elements, there are no nozzles presently available for directing fluid toward the bearing seals to prevent the buildup of cutting fines and shale packings around the bearing seals at the backface of the cutter cones. Thus, there is a need for an improved drilling fluid nozzle that directs some fluid toward the backface of the cutter cone to prevent abrasive formation cuttings from damaging the cutter cone bearings and seals.

SUMMARY OF THE INVENTION

The present invention comprises an extended nozzle for directing the flow of drilling fluid in a well hole drill bit. The nozzle is a modification and improvement of the removable drill bit nozzle disclosed in U.S. Pat. No. 4,082,015. The extended nozzle of the present invention includes side discharge ports for directing jets of drilling fluid toward the area of the cutter cone bearing seals on the backface of the cutter cones. The purpose of the present invention is to extend the life of cutter cone seals and bearings by blocking or washing away abrasive formation cuttings that otherwise collect around the area of the bearing seals during the drilling operation.

In a typical well hole drill bit, three cutter cones are mounted on downwardly extending shirttails of the drill bit. The rolling cutter cones may be mounted on the shirttails with journal or roller bearings having O-ring or other type seals to prevent abrasive material from damaging the bearings. Drill bits utilizing three cutter cones generally include three fluid nozzles, with a nozzle positioned between each pair of shirttails and cutter cones so as to direct drilling fluid downward between adjacent cutter cones.

In drill bits having cutter cones with bearings, the bearing seals are located between the backface of the cutter cone and the inside surface of the shirttail of the drill bit. During drilling operations, drilling fines and shale packings can collect around the backfaces of the cutter cones in the area of the bearing seals. This collection of abrasive particles is detrimental to the life of the seals and can result in destruction of the seals and failure of the bearings.

The nozzle of the present invention extends downward from the drill bit between adjacent shirttails of the bit. The extended portion of the nozzle includes two side ports to direct a portion of the drilling fluid toward the area of the cutter cone bearing seals. One of the side ports is angled to direct fluid toward the seals of the leading cone and the other side port is angled to direct fluid toward the seals of the trailing cone. Approximately 10 of the total drilling fluid is directed through the side ports. The percentage of the total drilling fluid directed through the side ports is limited so as not to reduce the efficiency of the fluid directed downward between the adjacent cutter cones. The side jets of fluid impact between the cone backfaces and the drill bit shirttails to remove cutting fines and shale packings from the area around the bearing seals. The action of the side jets of fluid reduce the abrasion on the seals and extend the life of the seals and the bearings of the cutter cones.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENT

Figure 1:
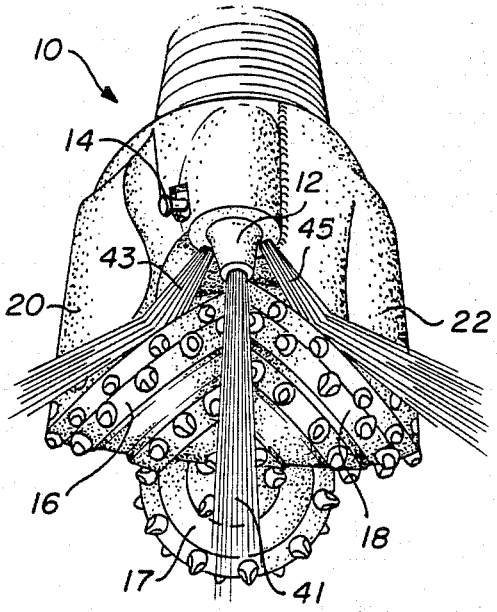
FIG. 1 is a perspective view of a three-cone drill bit illustrating the extended nozzle of the present invention positioned between adjacent shirttails of the drill bit.
Figure 1A:
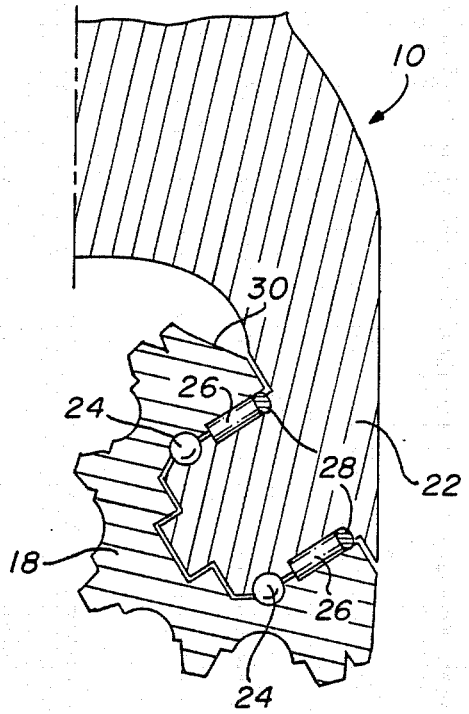
FIG. 1A is a partial cut-away view of a drill bit illustrating the bearings and bearing seals of a cutter cone.

Referring to the Drawings, wherein like reference numerals designate like or corresponding parts throughout the several views, FIG. 1 illustrates a well hole drill bit 10 having an extended nozzle 12 of the present invention. Extended nozzle 12 is a removable nozzle that is secured in drill bit 10 by means of a retaining pin 14 as disclosed by U.S. Pat. No. 4,082,015 to Craig. The nozzle 12 of the present invention is lengthened to extend downward from drill bit 10 when mounted. Drill bit 10 typically has three cutter cones 16–18, wherein each cutter cone is mounted on a shirttail such as shirttails 20 and 22 of drill bit 10.

As more clearly shown in FIG. IA, cutter cone 18 may be mounted on shirttail 22 by means of a bearing system including ball bearings 24, journal or roller bearings 26, and bearing seals 28. The remaining cutter cones 16, 17 are mounted similarly on their respective shirttails of drill bit 10. The backface 30 of cutter cone 18 abuts the inner surface of shirttail 22. Bearing seal 28, which may comprise an O-ring or other type seal, prevents abrasive particles produced by the drilling operation from entering the area of bearings 24 and 26.

Figure 2:
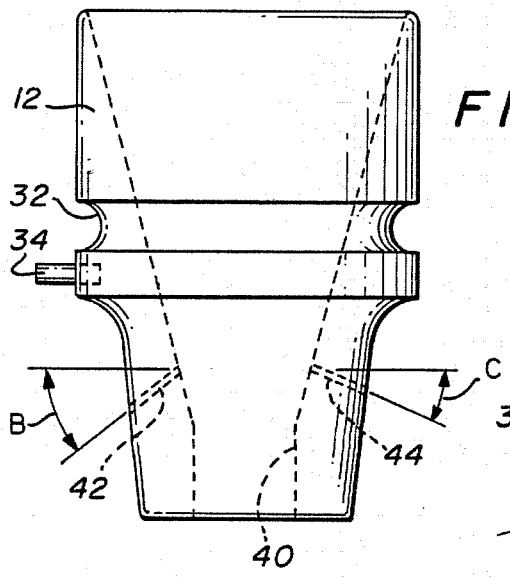
FIG. 2 is a side plan view of the extended nozzle of the present invention.
Figure 3:
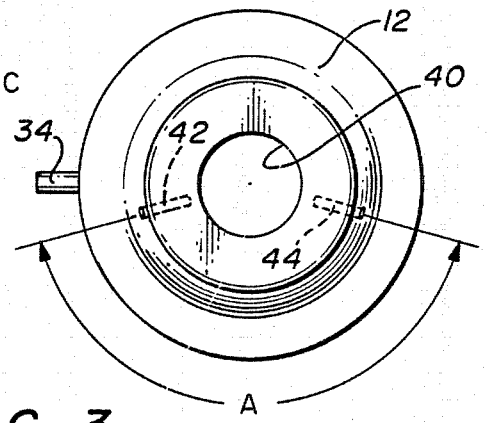
FIG. 3 is a bottom plan view of the extended nozzle of the present invention.

As shown in FIGS. 2 and 3, nozzle 12 includes a groove 32 for receiving pin 14, and a means, such as an indexing pin 34, for properly orienting nozzle 12 in drill bit 10. Nozzle 12 includes a main discharge port 40 and side ports 42 and 44. Side ports 42 and 44 are displaced from each other around the circumference of nozzle 12 at an angle A, which may be approximately 150 degrees depending upon the type and size of drill bit 10. Side ports 42 and 44 are angled downward from the horizontal at angles B and C, respectively. The optimum for angles B and C varies depending upon the size of drill bit 10 and the type of cutter cones 16–18.

As shown in FIG. 1, nozzle 12 extends from drill bit 10 so that side ports 42 and 44 direct side jets of fluid 43 and 45, respectively, while main port 40 directs the main jet 41 of drilling fluid downward. Jets 43 and 45 are directed toward the area between the backfaces of the cutter cones and the inner surfaces of the shirttails. The side jets 43 and 45 wash abrasive materials produced during the drilling operation away from the area of the bearing seals 28. Angles B and C of side ports 42 and 44, respectively, may have slightly different angles so that jet 43 washes away material coming up from the bottom with leading cone 16 and jet 45 washes away material coming over the top with trailing cone 18. Side jets 43 and 45 are limited to approximately 10% of the total fluid flow through nozzle 12 so as not to reduce the efficiency of the main jet 41 directed downward between the adjacent cutter cones. Thus, side jets 43 and 45 wash away abrasive materials that otherwise would collect between the cone backfaces and the inner surfaces of the shirttails so that the life of the bearings and seals may be prolonged.

Whereas the present invention has been described with respect to a specific embodiment thereof, various changes and modifications may be suggested to one skilled in the art, and it is intended that the present invention encompass such changes and modifications as fall within the scope of the appended claims.

I claim:

1. A fluid nozzle for a well hole drill bit having a plurality of cutter cones mounted on a respective plurality of drill bit shirttails, comprising:

a body having a top, a bottom and a sidewall;

said body having a central aperture extending therethrough from said top to said bottom, and being mounted on the drill bit between adjacent cutter cones and extending toward the plurality of cutter cones, such that drilling fluid passes through said central aperture into an area between adjacent cutter cones;

a first channel formed in said body and extending through said sidewall, said first channel being in fluid communication with said central aperture and disposed at an angle to said central aperture, such that drilling fluid passes through said first channel into an area between a backface of a leading cutter cone and a respective leading shirttail; and a second channel formed in said body and extending through said sidewall, said second channel being spaced apart from said first channel and in fluid communication with said central aperture and disposed at an angle to said central aperture, such that drilling fluid passes through said second channel into an area between a backface of a trailing cutter cone and a respective trailing shirttail.

2. The fluid nozzle of claim 1 and further including:

means for aligning said body to position said first and said second channels with respect to the plurality of cutter cones.

3. The fluid nozzle of claim 2 wherein said means for aligning said body comprises an indexing pin extending radially outward from said body.

4. The fluid nozzle of claim 1 and further including:

means for aligning said body to position said first and second channels, such that adjacent cutter cones rotate into the drilling fluid flowing from said first and second channels.

5. The fluid nozzle of claim 1 wherein said first and second channels are sized to permit approximately 10 percent of the drilling fluid to flow therethrough with the remaining drilling fluid flowing through said central aperture.

* * * * *

UNITED STATES PATENT AND TRADEMARK OFFICE

CERTIFICATE OF CORRECTION

PATENT NO. : 4,784,231

DATED : Nov. 15, 1988

INVENTOR(S) : Higgins

It is certified that error appears in the above-identified patent and that said Letters Patent is hereby corrected as shown below:

Column 2, line 20, change 10 to --10%--.

Signed and Sealed this

Eleventh Day of April, 1989

*Attest:*

DONALD J. QUIGG

*Attesting Officer*

*Commissioner of Patents and Trademarks*